US010214330B2

(12) United States Patent
Leimone et al.

(10) Patent No.: US 10,214,330 B2
(45) Date of Patent: Feb. 26, 2019

(54) FLUID CONTAINER WITH AXIS STRAW

(71) Applicant: Lifefactory, Inc., Sausalito, CA (US)

(72) Inventors: John Paul Leimone, Sausalito, CA (US); Shane Rogers, Sausalito, CA (US); Brian Holm, Sausalito, CA (US)

(73) Assignee: THERMOS LLC, Schaumburg, IL (US)

( * ) Notice: Subject to any disclaimer, the term of this patent is extended or adjusted under 35 U.S.C. 154(b) by 177 days.

(21) Appl. No.: 15/391,600

(22) Filed: Dec. 27, 2016

(65) Prior Publication Data

US 2017/0190481 A1 Jul. 6, 2017

Related U.S. Application Data

(60) Provisional application No. 62/273,316, filed on Dec. 30, 2015.

(51) Int. Cl.

| | |
|---|---|
| ***A47G 19/22*** | (2006.01) |
| ***B65D 47/32*** | (2006.01) |
| ***B65D 47/06*** | (2006.01) |
| ***B65D 47/20*** | (2006.01) |
| ***B65D 25/28*** | (2006.01) |
| ***A47G 21/18*** | (2006.01) |
| *B65D 83/28* | (2006.01) |

(52) U.S. Cl.

CPC ..... *B65D 47/32* (2013.01); *A47G 19/2272* (2013.01); *A47G 21/18* (2013.01); *B65D 25/28* (2013.01); *B65D 47/065* (2013.01); *B65D 47/2006* (2013.01); *B65D 2525/283* (2013.01)

(58) Field of Classification Search

CPC .... A47G 19/2272; A47G 21/18; B65D 47/32; B65D 25/28; B65D 47/065; B65D 47/2006; B65D 2525/283

USPC ..... 215/388; 220/707, 708, 709, 714, 717

See application file for complete search history.

(56) References Cited

U.S. PATENT DOCUMENTS

| | | | | |
|---|---|---|---|---|
| 4,440,327 | A | 4/1984 | Dark | |
| 5,873,478 | A | 2/1999 | Sullivan et al. | |
| 6,116,458 | A | 9/2000 | Dark | |
| 6,523,711 | B1 * | 2/2003 | Hughes | A47G 19/2266 215/308 |
| 7,516,862 | B2 | 4/2009 | McDonough | |
| 8,307,755 | B2 * | 11/2012 | Shen | A47J 31/20 220/501 |

(Continued)

*Primary Examiner* — J. Gregory Pickett
*Assistant Examiner* — Niki M Eloshway
(74) *Attorney, Agent, or Firm* — The Mueller Law Office, P.C.

(57) ABSTRACT

A fluid container cover includes a cap having an outer and an inner surface. The inner surface is capable of being coupled to the fluid container. A spout includes a drinking portion, an actuation portion and a curved, distal end. The spout is capable of being actuated from a first closed position to a second open position by an external force. A flexible tube is coupled inside of the spout, and has a first end and a second end. An air venting component has a nub and a plurality of air vent holes. When the spout is in the first closed position, the flexible tube is deformed preventing flow through the spout. When the spout is actuated from the first closed position to the second open position, the curved, distal end of the spout deflects the nub allowing passage of air with the fluid container.

20 Claims, 14 Drawing Sheets

(56) References Cited

U.S. PATENT DOCUMENTS

| | | | | |
|---|---|---|---|---|
| 8,376,173 | B2 * | 2/2013 | Britto | B65D 47/066 206/217 |
| 8,777,048 | B2 | 7/2014 | Choi et al. | |
| 8,844,742 | B2 * | 9/2014 | Fujita | A47G 19/2266 215/307 |
| 9,162,802 | B2 | 10/2015 | El-Saden et al. | |
| 2006/0226110 | A1 * | 10/2006 | Choi | A47G 19/2266 215/228 |
| 2010/0181329 | A1 * | 7/2010 | Davies | A47G 19/2266 220/707 |
| 2012/0187075 | A1 * | 7/2012 | El-Saden | B65D 47/066 215/389 |
| 2012/0305559 | A1 * | 12/2012 | Steininger | B65D 47/065 220/253 |
| 2015/0164254 | A1 * | 6/2015 | Niedens | A47G 19/2266 220/714 |
| 2015/0173539 | A1 * | 6/2015 | Mason | A47G 19/2272 220/707 |
| 2015/0307265 | A1 * | 10/2015 | Winn | A23L 2/395 426/66 |
| 2015/0336721 | A1 * | 11/2015 | Lu | B65D 51/20 220/708 |
| 2017/0208974 | A1 * | 7/2017 | Zhang | A47G 19/2272 |
| 2017/0225855 | A1 * | 8/2017 | Lawson | B65D 51/2807 |
| 2017/0340148 | A1 * | 11/2017 | Chen | A47G 19/2272 |

* cited by examiner

FLUID CONTAINER WITH AXIS STRAW

RELATED APPLICATIONS

This application claims priority to U.S. Provisional Patent Application No. 62/273,316, filed on Dec. 30, 2015 and entitled "Fluid Container Cover with Axis Straw", which is incorporated herein by reference in its entirety.

BACKGROUND

Portable drinking bottles have increased in popularity over the years not only because of increasingly active lifestyles, but also due to environmental concerns with disposable bottles. For example, replacing disposable water bottles with a single beverage container that may be cleaned and refilled many times greatly reduces the amount of waste produced. Fluid containers which can meet the needs of a person's or a family's activities while also being reusable is an increasingly growing market.

Drinking bottles are used by all ages—from children through adults—and in many situations. For example, these bottles are used for travel, recreation, sports, school and everyday activities. Straws or spouts that flip open on a bottle cover are known in the art. Conventional designs involve pulling the tip of the spout upward with one's finger, with the spout pivoting at its lower end where it is attached to the cap. Other designs have included rotating covers to fold and enclose a spout, push button actuation in which a spring assembly pops open the spout, or a flange or loop on the spout to assist a user in pulling the spout upward. Typically with these designs, once the straw or spout is open, it is set in one defined position.

Moreover, when the straw or spout is in the closed the position, pressure may increase in the drinking bottle due to, for example, a change in temperature. Upon this occurrence, when the straw or spout is moved to the open position, fluid from within the drinking bottle may unexpectedly be released through the straw or spout.

SUMMARY

A fluid container cover includes a cap having an outer surface and an inner surface. The inner surface is capable of being coupled to the fluid container. A spout includes a drinking portion, an actuation portion and a curved, distal end. The spout is capable of being actuated from a first closed position to a second open position by an external force applied on the actuation portion. A flexible tube is coupled inside of the spout. The flexible tube has a first end and a second end, where the second end is longer in length than the spout. An air venting component has a nub and a plurality of air vent holes. When the spout is in the first closed position, the flexible tube is deformed by the curved, distal end of the spout preventing flow through the spout. When the spout is actuated from the first closed position to the second open position, the curved, distal end of the spout deflects the nub of the air venting component allowing passage of air with the fluid container.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

Figure 1:
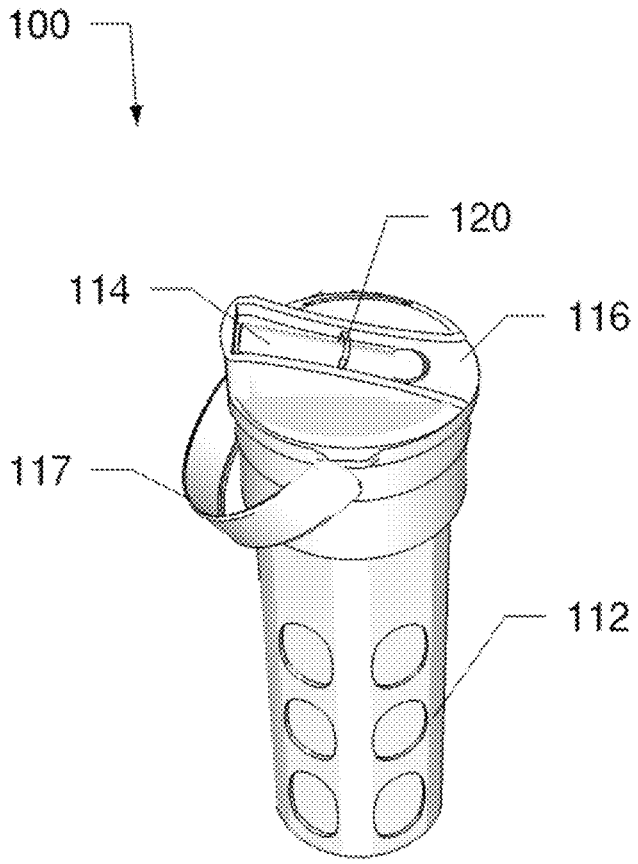
FIG. 1 is a perspective view of a fluid container cover with the spout closed, in accordance with some embodiments.

A fluid container cover is described herein. The cover includes a cap having an outer surface and an inner surface. The inner surface is capable of being coupled to the fluid container. A spout includes a drinking portion, an actuation portion and a curved, distal end. The spout is capable of being actuated from a first closed position to a second open position by an external force applied on the actuation portion. A flexible tube is coupled inside of the spout. The flexible tube has a first end and a second end, where the second end is longer in length than the spout. An air venting component has a nub and a plurality of air vent holes. When the spout is in the first closed position, the flexible tube is deformed by the curved, distal end of the spout preventing flow through the spout. When the spout is actuated from the first closed position to the second open position, the curved, distal end of the spout deflects the nub of the air venting component allowing passage of air with the fluid container.

The fluid container cover may further include the spout having a protrusion on the curved, distal end and the outer surface of the cap having a depression and a slot. The slot may be configured to receive the protrusion of the spout, allowing radial rotation of the spout while preventing twisting of the spout in the second open position. The spout may be received in the depression and allowed to rotate radially around the outer surface of the cap without twisting while in the second open position.

In some embodiments, the air venting component may be integral to the flexible tube. In some embodiments, the flexible tube may comprise of silicone. The air venting component may be capable of preventing fluid from exiting the spout when the spout is actuated from the first closed position to the second open position.

In various embodiments, the spout may be coupled to the cap by the air venting component. The spout may comprise a channel on an inside surface of the drinking portion, and the first end of the flexible tube may comprise a lip that may be capable of being seated in the channel of the spout. The spout may be capable of being actuated more than 90 degrees to the second open position. The curved, distal end of the spout may comprise a jut. The jut may deflect the nub of the air venting component when the spout is actuated from the first closed position to the second open position. The diameter of the curved, distal end of the spout may be greater than the diameter of the drinking portion of the spout.

The fluid container cover may further comprise the inner surface of the cap having a recess. The air venting component may be coupled to the recess of the inner surface of the cap. The recess of the inner surface of the cap may comprise grooves that seal with ribs on the air venting component, and the ribs may surround the air vent holes. The grooves may be unsealed from the ribs when the nub of the air venting component is deflected. In accordance with some embodiments, the plurality of air vent holes may be configured in a circular array.

The air venting component may further comprise a support configured to receive a straw and the straw being coupled to the flexible tube. In various embodiments, the straw may extend up to 8 inches into the fluid container.

The present disclosure also describes a fluid container cover including a cap having an outer surface and an inner surface. The outer surface has a depression with a slot in a perimeter of the depression, and the inner surface is capable of being coupled to the fluid container. A spout includes a drinking portion, an actuation portion, a protrusion and a curved, distal end. The spout is capable of being pivotally actuated from a first closed position to a second open position by an external force applied on the actuation portion. A flexible tube is coupled inside of the spout and the length of the flexible tube extends past the curved, distal end of the spout. An air venting component has a nub and a plurality of air vent holes. When the spout is in the first closed position, the flexible tube is deformed by the curved, distal end of the spout preventing flow through the spout. When the spout is actuated from the first closed position to the second open position, the curved, distal end of the spout deflects the nub of the air venting component allowing passage of air with the fluid container. The protrusion of the spout is received by the slot of the cap allowing radial movement of the spout while preventing twisting with respect to a longitudinal axis of the spout when in the second open position.

The present disclosure describes a fluid container cover having a flip up spout which may be conveniently stored in the closed position. A flexible tube, comprised of silicone in some embodiments, is coupled inside of the spout providing the path through which fluid is consumed from the fluid container. In some embodiments, an air venting component is coupled to the flexible tube and in combination, acts as a valve to prevent fluid from flowing when the spout is in the closed position and also allows air into the fluid container to replace the volume of fluid consumed by a user. The fluid container cover enables built up pressure to be vented out of the fluid container when the spout is opened. In addition, because of the molded shape of the flexible tube within the spout, once the user opens the spout, the flexible tube forces the spout to spring open to an upright position. The spout may also be manipulated about two different planes while the spout is in the open position in order to meet the needs of the user.

Figure 2:
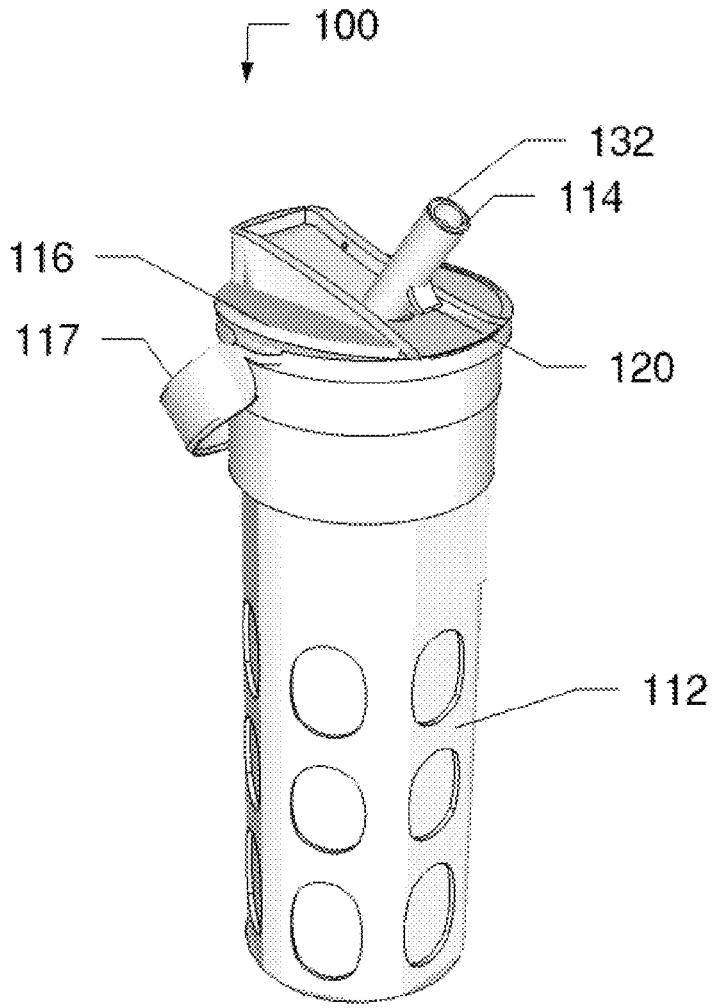
FIG. 2 shows a perspective view of a fluid container cover with the spout open, in accordance with some embodiments.
Figure 3:
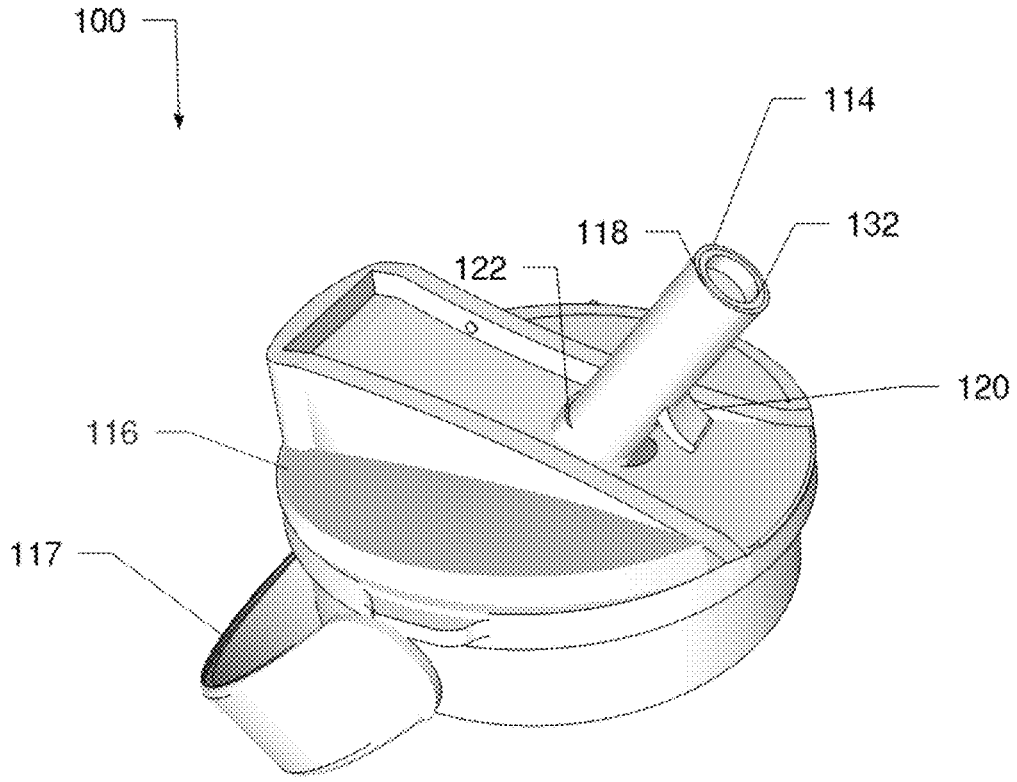
FIG. 3 depicts a perspective view of a fluid container cover, in accordance with some embodiments.

FIG. 1 is a perspective view of a fluid container cover 100 in one mode, in accordance with some embodiments. The cover 100 is coupled to a fluid container 112, and a spout 114 is in a first closed position. The fluid container 112 is depicted as a cylindrical bottle in this disclosure; however, the present disclosure may apply to any fluid container such as mugs, jars, carafes and the like. FIG. 2 shows a perspective view of the fluid container cover 100 in another mode, in accordance with some embodiments. The cover 100 is coupled to the fluid container 112, and a spout 114 is in a second open position. FIG. 3 depicts a perspective view of a fluid container cover 100, in accordance with some embodiments. The cover 100 includes a cap 116 having an outer surface and an inner surface. The inner surface of the cap 116 is capable of being coupled to the fluid container 112 as shown in FIGS. 1 and 2. In some embodiments, a handle 117 is coupled to the cap 116. The spout 114 includes a drinking portion 118, an actuation portion 120 and a curved, distal end 122. The spout 114 is capable of being actuated from a first closed position to a second open position by an external force applied on the actuation portion 120. In accordance with some embodiments, the spout 114 may be capable of being actuated more than 90 degrees to the second open position.

Figure 4:
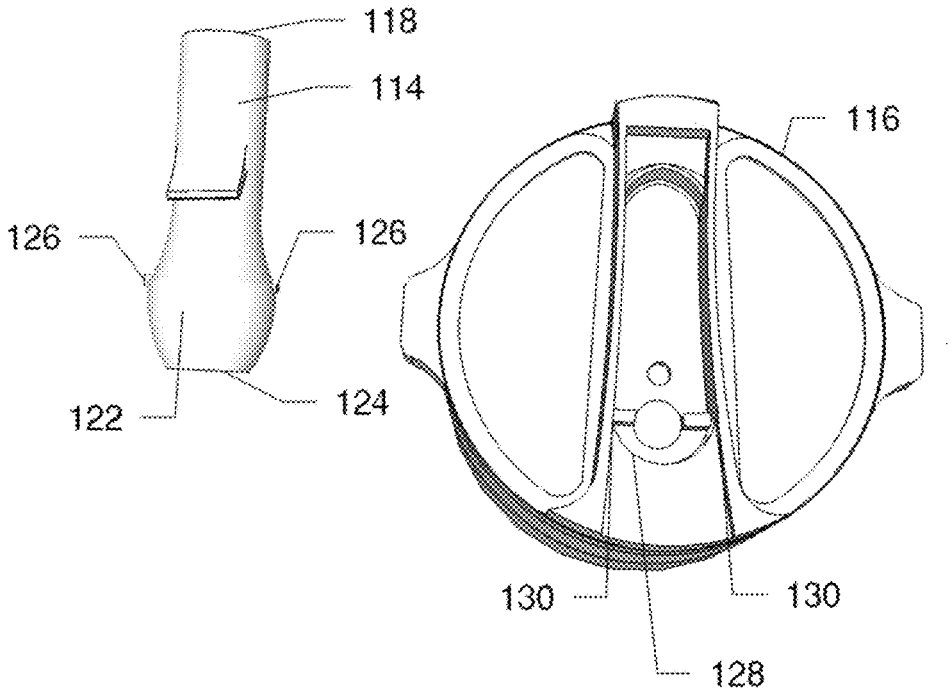
FIG. 4 is a top view of the cap, in accordance with some embodiments.
Figure 5:
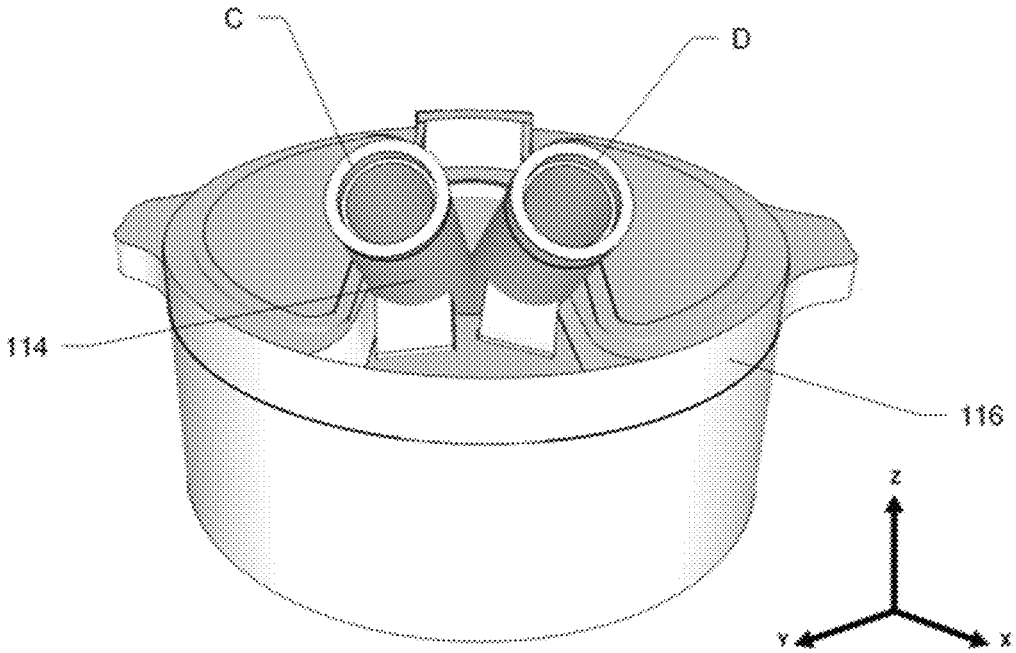
FIG. 5 is a perspective view of the cover, in accordance with some embodiments.
Figure 6:
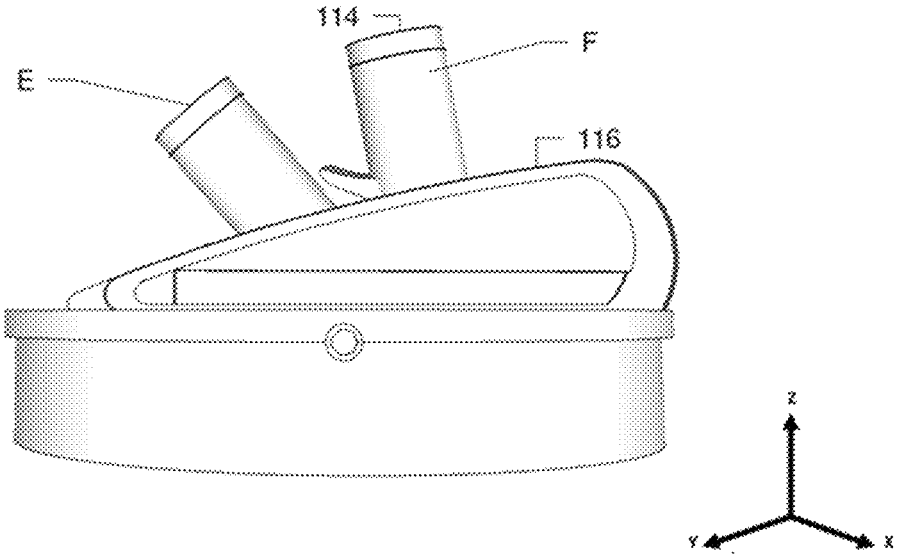
FIG. 6 is a side view of the cover of FIG. 5, in accordance with some embodiments.

FIG. 4 is a top view of the cap 116, in accordance with some embodiments. In this view, the spout 114 is depicted as being removed from the cap 116, for clarity. The curved, distal end 122 of the spout 114 may comprise a jut 124. The diameter of the curved, distal end 122 of the spout 114 may be greater than the diameter of the drinking portion 118 of the spout 114. The spout 114 may have one or more protrusions 126 on the curved, distal end 122, and the outer surface of the cap 116 may have a depression 128 and a slot 130. The slot 130 may be positioned along the perimeter of the depression 128 of the cap 116. The slot 130 may be configured to receive the protrusion 126 of the spout 114 when the spout 114 is positioned in the depression 128, allowing radial rotation of the spout 114 while preventing twisting of the spout 114 in the second open position. The spout 114 may be received in the depression 128 and allowed to rotate, such as up to 360 degrees, in the xy-plane without twisting about the longitudinal axis of the spout 114 while in the second open position (where the longitudinal axis is shown to be approximately oriented in the direction of the z-axis in FIGS. 5-6). In this way, the spout 114 is not in a fixed position once opened, and can in fact move in two planes. That is, the spout 114 is able to move radially around the surface of the cap 116 when in the open position of FIG. 5, where the spout 114 is shown in two example positions C and D. These laterally offset positions C and D enable a user to access the spout 114 from multiple directions, thus improving ease of use. The second plane of motion occurs when the spout 114 pivots between an open and closed position. For example in FIG. 6, position E shows an intermediate position as the spout 114 moves to the fully open position F. Thus, FIG. 5 is a perspective view of the cover 100, in accordance with some embodiments and FIG. 6 is a side view of the cover 100 of FIG. 5, in accordance with some embodiments. Both illustrate the spout 114 moving about two planes within the cap 116. The spout 114 cannot twist about its own axis, because of protrusions 126 which engage in the slots 130 on the cap 116.

Figure 7:
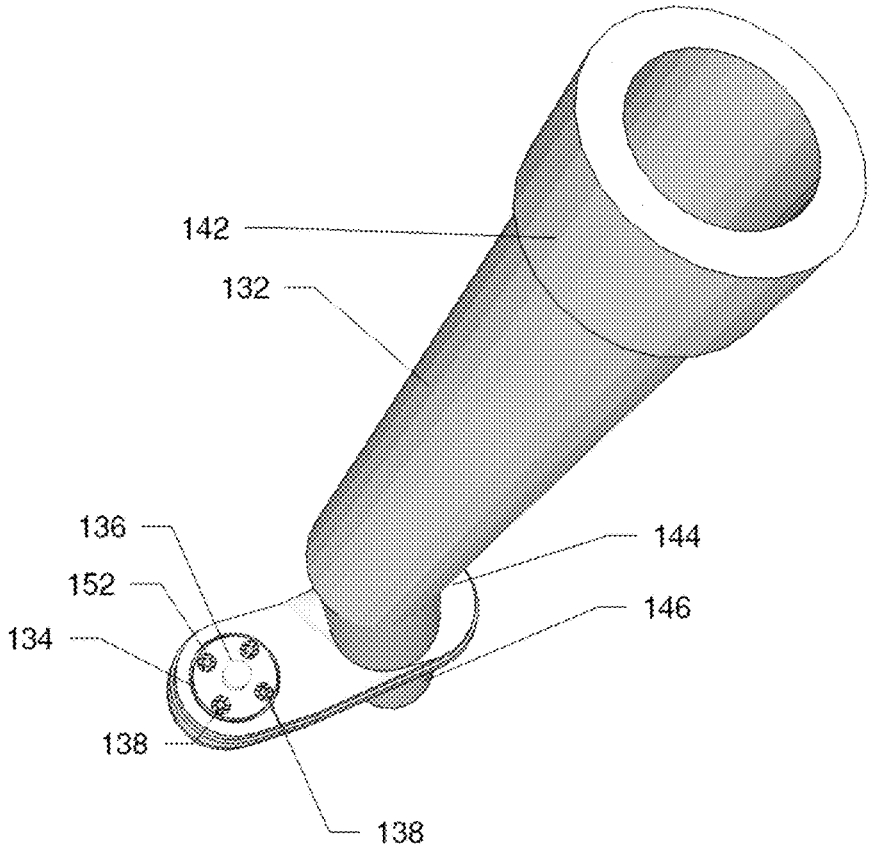
FIG. 7 shows a front view of the flexible tube, in accordance with some embodiments.
Figure 8:
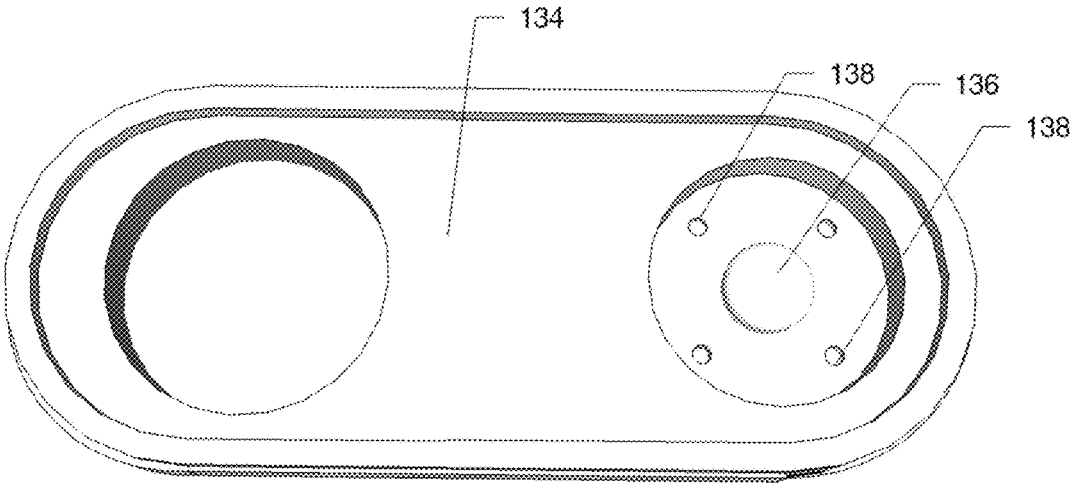
FIG. 8 is a is close up view of the air venting component for the embodiment shown in FIG. 7.

A flexible tube 132 is coupled inside of the spout 114, as indicated in FIGS. 2 and 3. The flexible tube 132 has a first end and a second end, where the first end is placed at the drinking portion 118 of the spout 114. The second end is longer in length than the spout 114 so that the tube 132 can extend into the fluid container to retrieve liquid. The non-twisting design of the spout 114, as described above, prevents the flexible tube 132 from becoming kinked in the open position, which would occlude fluid flow. FIG. 7 shows a front view of the flexible tube 132 removed from spout 114 and cap 116, in accordance with some embodiments. An air venting component 134 has a nub 136 and a plurality of air vent holes 138. In some embodiments, the plurality of air vent holes 138 may be configured in a circular array. In other embodiments, the air vent holes 138 may be in other suitable patterns. In the embodiment of FIG. 7, four air vent holes 138 are arranged in a circular array around the nub 136. FIG. 8 is close up view of the nub 136 and a plurality of air vent holes 138 of the air venting component 134 for the embodiment shown in FIG. 7.

In some embodiments, the air venting component 134 may be integral to the flexible tube 132. In other embodiments, the air venting component 134 may be a separate component from the flexible tube 132. The flexible tube 132 may be comprised of silicone or other suitable materials. The spout 114 may comprise a channel 140 (shown in FIG. 12) on an inside surface of the drinking portion 118, and the first end of the flexible tube 132 may comprise a lip 142 that may be capable of being seated in the channel 140 of the spout 114. The air venting component 134 may further comprise a support 144 configured to receive a straw 146, where the straw couples to the flexible tube 132. The straw 146 may extend up to 8 inches into the fluid container 112 or any suitable length needed in order to withdraw the fluid within fluid container 112. In further embodiments, the straw 146 may be integral to the flexible tube 132, the air venting component 134 or to both. In yet other embodiments, the straw 146 and flexible tube 132 may extend into the fluid container 112 without the presence of a support 144.

Figure 9:
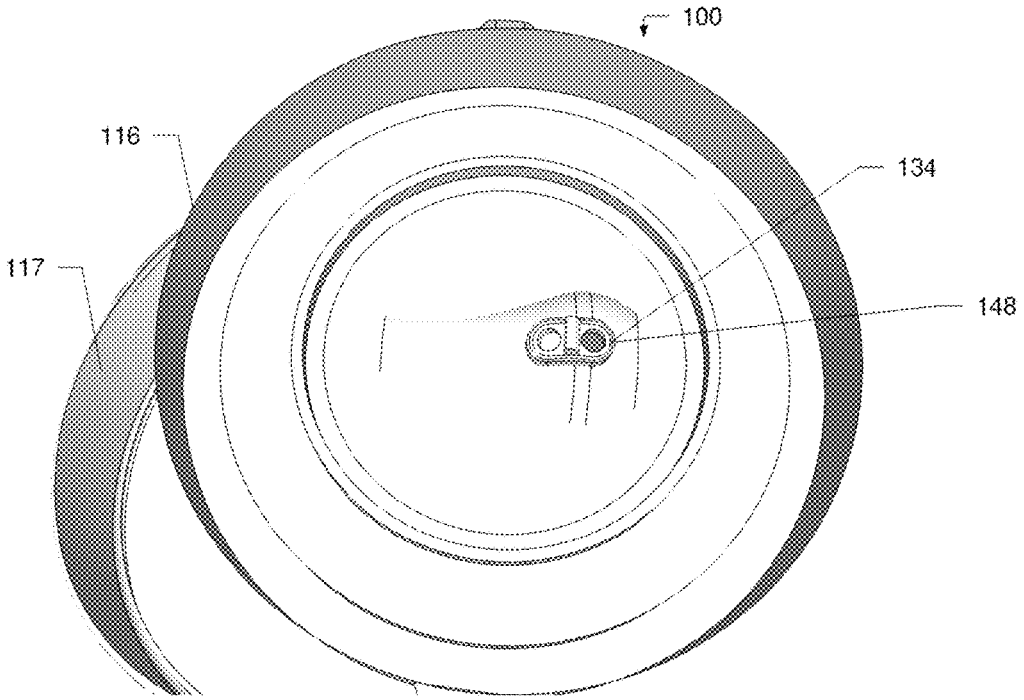
FIG. 9 is a bottom view of the cover, in accordance with some embodiments.
Figure 10:
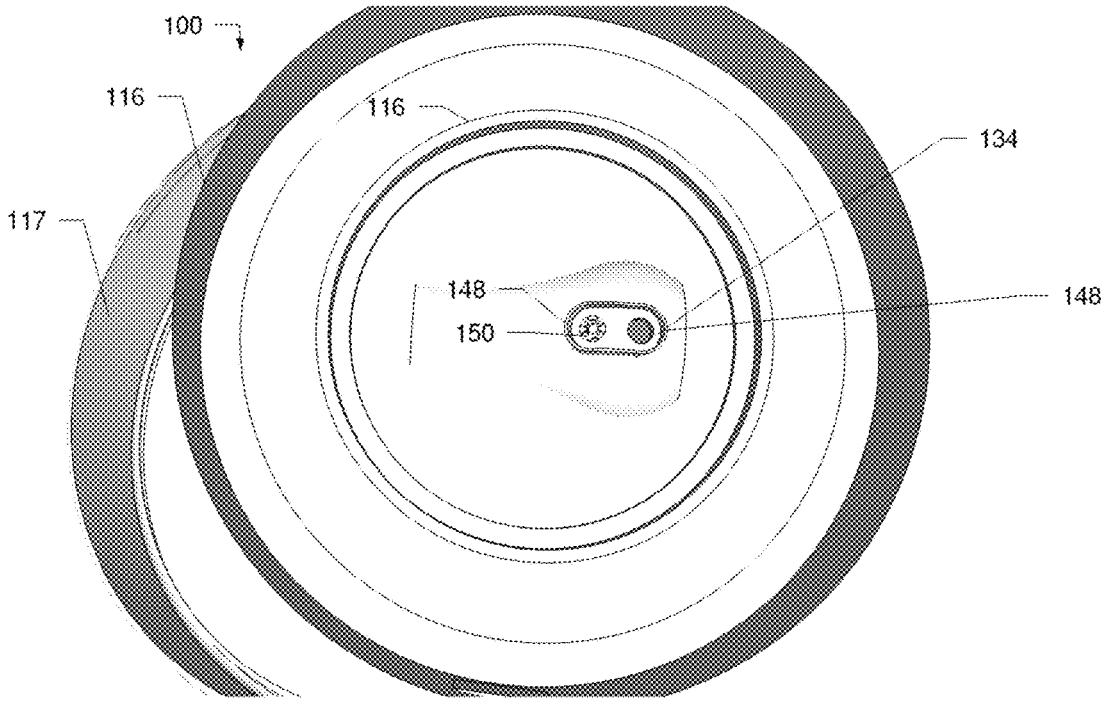
FIG. 10 is a close up bottom view of the cover, in accordance with some embodiments.
Figure 11:
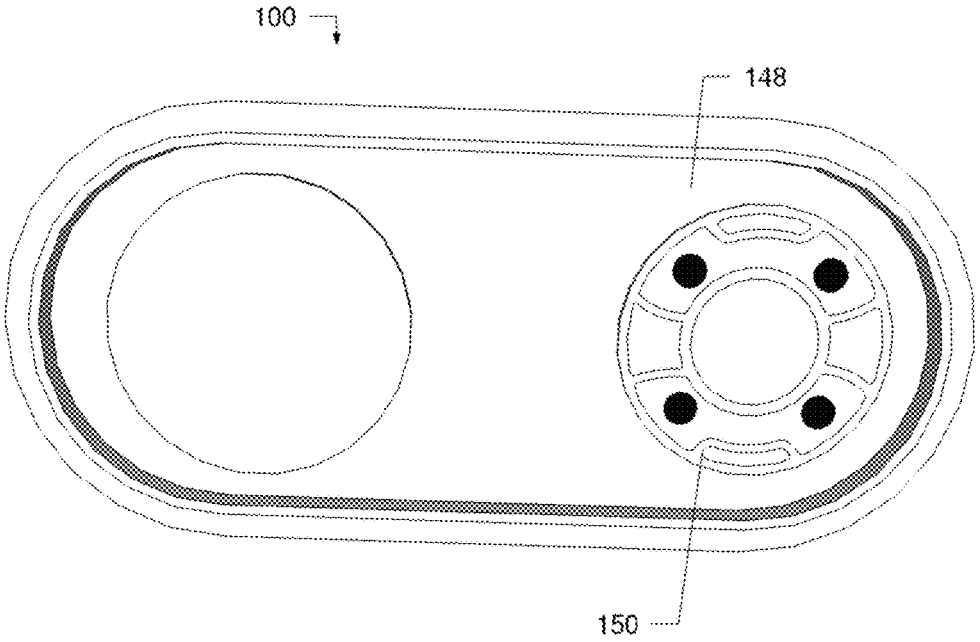
FIG. 11 shows a bottom view of the cover, in accordance with some embodiments.

In some embodiments, the spout 114 may be coupled to the cap by the air venting component 134. FIG. 9 is a bottom view of the cover 100, in accordance with some embodiments. The inner surface of the cap 116 is shown and is capable of being coupled to the fluid container 112. The cover 100 may further comprise the inner surface of the cap 116 having a recess 148. The air venting component 134 may be coupled to the recess 148 of the inner surface of the cap 116. This may be accomplished by a push fit, snap fit, fasteners or the like. FIGS. 10 and 11 are also a bottom view of the cover 100, in accordance with some embodiments. The air venting component 134 is not shown. The recess 148 of the inner surface of the cap 116 may comprise grooves 150 that seal with ribs 152 on the air venting component 134 (shown in FIG. 7), and in various embodiments, the ribs 152 may surround the air vent holes 138.

Figure 12:
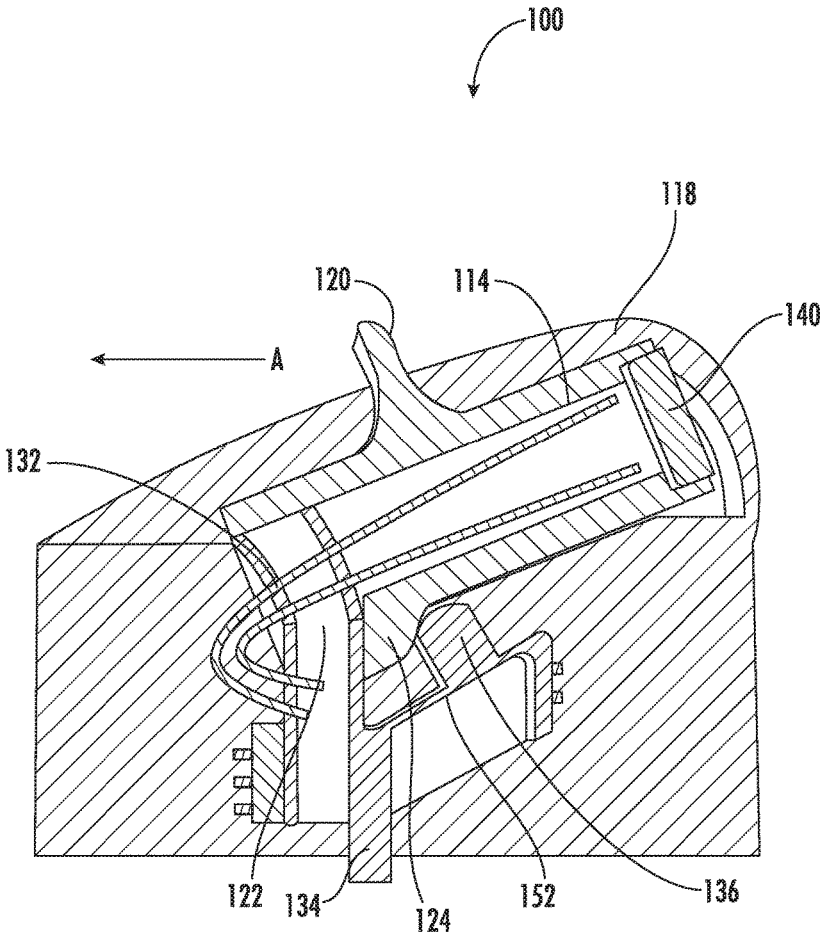
FIG. 12 illustrates a sectional view of the spout in the first closed position, in accordance with some embodiments.

FIG. 12 illustrates a sectional view of the spout 114 in the first closed position, in accordance with some embodiments. When the spout 114 is in the first closed position, the flexible tube 132 is deformed by the curved, distal end 122 of the spout 114 preventing flow through the spout 114. In this mode, a section of the flexible tube 132 is kinked, pinched or bent, closing off the fluid path, thereby blocking fluid passage through the flexible tube 132 or spout 114 and preventing leakage of the fluid within the fluid container 112.

Figure 13:
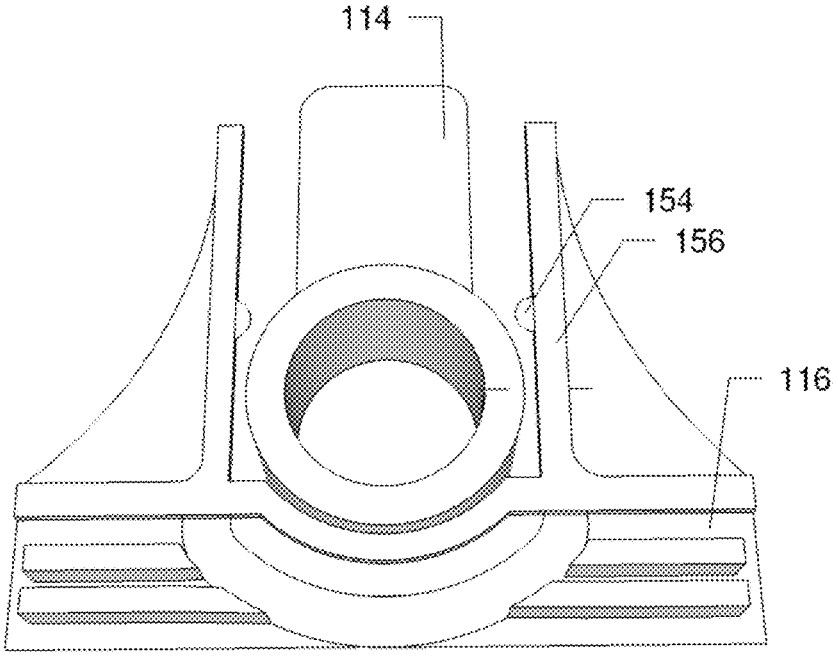
FIG. 13 depicts a front view of the spout in the first closed position, in accordance with some embodiments.

FIG. 13 depicts a front view of the spout 114 in the first closed position, in accordance with some embodiments. When the spout 114 is in the first closed position, the spout 114 is held down by bumps 154 on the side walls 156 of the cap 116. To open the spout 114, a force is applied on the actuation portion 120 as shown with arrow A in FIG. 12. The force applied is required to move the spout 114 past the bumps 154 holding down the spout 114. Once the user applies a force on the actuation portion 120 to move the spout 114, the flexible tube 132 coupled inside of the spout 114 forces the spout 114 to spring open to a prone, quasi-upright position due to the molded shape of the flexible tube 132. The user may now consume the contents of the fluid container 112 via the spout 114. When the user is finished, the spout 114 may be pushed from the second open position to the first closed position past the bumps 154. The spout 114 is then securely held in the first closed position.

Referring to FIG. 12, when the spout 114 is actuated from the first closed position to the second open position, the curved, distal end 122 of the spout 114 deflects the nub 136 of the air venting component 134 allowing passage of air with the fluid container 112. In some embodiments, the jut 124 of spout 114 may deflect the nub 136 of the air venting component 134 when the spout 114 is actuated from the first closed position to the second open position. Moreover, referring to FIGS. 7 and 10, the grooves 150 may be separated or unsealed from the ribs 152 when the nub 136 of the air venting component 134 is deflected. In other embodiments, the grooves and ribs may be located on the recess 148 of the cap 116 and mate to a flat, smooth surface on the air venting component 134. The air venting holes 138 may be located on the smooth flat surface. The air venting component 134 may be capable of preventing fluid from exiting the spout 114 when the spout 114 is actuated from the first closed position to the second open position. For example, as the spout 114 continues to open, it deflects the nub 136 out of the way and breaks the seal between the cap 116 and the air venting component 134. By breaking the seal, it allows pressure that may be built up inside the fluid container 112 to escape.

Figure 14:
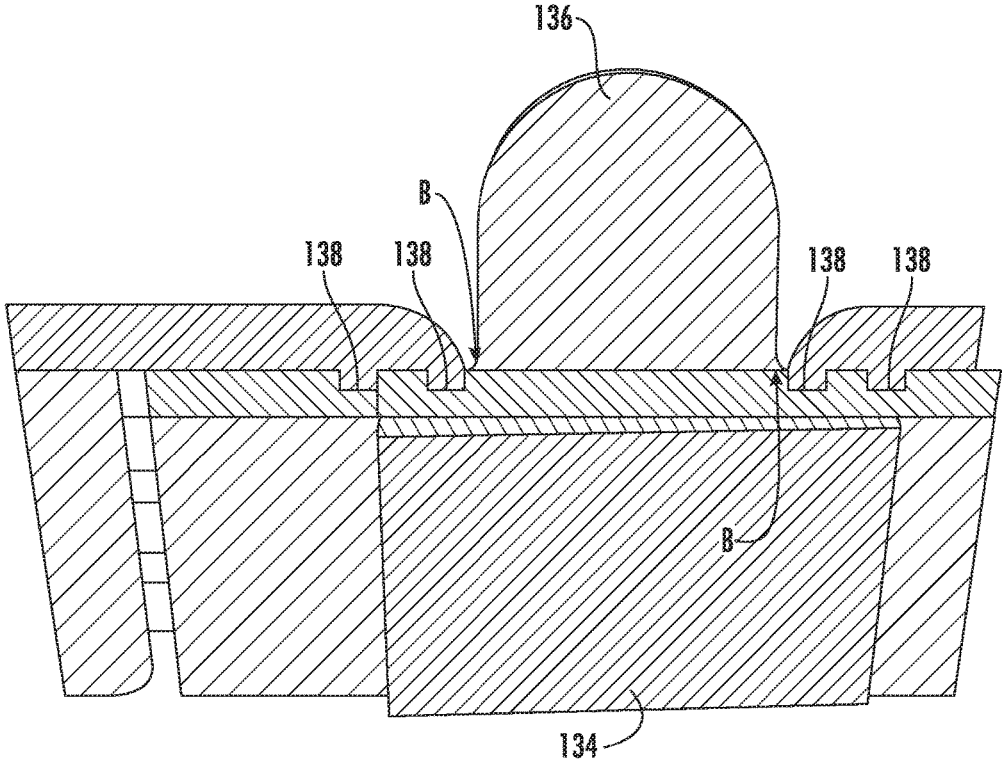
FIG. 14 is a sectional view of the air venting component, in accordance with some embodiments.

FIG. 14 is a sectional view of the air venting component 134, in accordance with some embodiments. The air vent holes 138 provide a path for air passage to and from the fluid container 112. For example, while the user consumes fluid from the fluid container 112, a vacuum effect is created inside of the fluid container 112 as the fluid level decreases. The vacuum acts on the inside surface of the air venting component 134 and draws the venting component 134 away from the sealing surface or recess 148 on the cap 116. In doing so, air is allowed to flow from outside of the cap 116 into the fluid container 112 through the air vent holes 138 and as indicated by arrows B.

The present disclosure also describes a fluid container cover 100 including a cap having an outer surface and an inner surface. The outer surface has a depression 128 with a slot 130 in a perimeter of the depression 128 and the inner surface is capable of being coupled to the fluid container 112. A spout 114 includes a drinking portion 118, an actuation portion 120, a protrusion 126 and a curved, distal end 122. The spout 114 is capable of being pivotally actuated from a first closed position to a second open position by an external force applied on the actuation portion 120. A flexible tube 132 is coupled inside of the spout 114 and the length of the flexible tube 132 extends past the curved, distal end 122 of the spout 114. An air venting component 134 has a nub 136 and a plurality of air vent holes 138. When the spout 114 is in the first closed position, the flexible tube 132 is deformed by the curved, distal end 122 of the spout 114 preventing flow through the spout 114. When the spout 114 is actuated from the first closed position to the second open position, the curved, distal end 122 of the spout 114 deflects the nub 136 of the air venting component 134 allowing passage of air with the fluid container 112. The protrusion 126 of the spout 114 is received by the slot 130 of the cap 116 allowing radial movement of the spout 114 while preventing twisting with respect to a longitudinal axis of the spout 114 when in the second open position.

The air venting component 134 in combination with the flexible tube 132 may act as a valve to prevent fluid from flowing when the spout 114 is in the closed position because the flexible tube 132 is pinched or kinked by the spout 114. Additionally, the air venting component 134 in combination with the flexible tube 132 allows ambient air into the fluid container 112 through the flexible tube 132 to replace the volume of fluid consumed by a user. The air venting component 134 also enables built up pressure within the fluid container 112 to be vented out through the air vent holes 138 when the spout 114 is opened thereby preventing fluid escaping through the flexible tube 132 or spout 114. This feature ensures that during a pressure change in the fluid container, for example, the temperature increasing such as on a hot day, the fluid does not "spit back" or flow out of the spout 114 when moved to an open position. This is accomplished by the interaction of the curved, distal end 122 of the spout 114 deflecting the nub 136 on the air venting component 134.

The molded shape of the flexible tube 132 within the spout 114 forces the spout 114 to spring open to a prone, quasi-upright position when the spout 114 is moved from a first closed position to the second open position. When the spout 114 is in the open position and ready for use, the spout 114 may also be manipulated about two different planes providing adjustability and customization by the user. This may increase user-friendliness. In contrast, with conventional fluid containers, once the mouthpiece or spout is open, it is confined to one set position. This is achieved by the protrusions 126 on the spout 114 being received by the slots 130 on the cap 116, while the curved, distal end 122 is positioned in the depression 128 of the cap 116.

The various components of the cap assembly in this disclosure, such as the spout 114, the cap 116 and the flexible tube 132, may be made of suitable plastics including but not limited to polypropylene, silicone, polyethylene, polycarbonate, or nylon. In other embodiments, the cap 116 may be made from, for example, glass, wood, stainless steel, aluminum, or titanium. The components may be produced by, for example, injection molding or other plastic manufacturing methods known in the art.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the invention. Thus, it is intended that the present subject matter covers such modifications and variations.

What is claimed is:

1. A fluid container cover comprising:

a cap having an outer surface and an inner surface, the inner surface capable of being coupled to the fluid container;

a spout comprising a drinking portion, an actuation portion and a curved, distal end, wherein the spout is capable of being actuated from a first closed position to a second open position by an external force applied on the actuation portion;

a flexible tube coupled inside of the spout, the flexible tube having a first end and a second end, the second end being longer in length than the spout; and an air venting component having a nub and a plurality of air vent holes;

wherein when the spout is in the first closed position, the flexible tube is deformed by the curved, distal end of the spout preventing flow through the spout; and wherein when the spout is actuated from the first closed position to the second open position, the curved, distal end of the spout deflects the nub of the air venting component allowing passage of air with the fluid container.

2. The fluid container cover of claim 1, further comprising:

the spout having a protrusion on the curved, distal end; and the outer surface of the cap having a depression and a slot, the slot configured to receive the protrusion of the spout, allowing radial rotation of the spout while preventing twisting of the spout in the second open position.

3. The fluid container cover of claim 2, wherein the spout is received in the depression and allowed to rotate radially around the outer surface of the cap without twisting while in the second open position.

4. The fluid container cover of claim 1, wherein the air venting component is integral to the flexible tube.

5. The fluid container cover of claim 1, wherein the spout is coupled to the cap by the air venting component.

6. The fluid container cover of claim 1, wherein the spout comprises a channel on an inside surface of the drinking portion; and wherein the first end of the flexible tube comprises a lip that is capable of being seated in the channel of the spout.

7. The fluid container cover of claim 1, further comprising:

the inner surface of the cap having a recess;

wherein the air venting component is coupled to the recess of the inner surface of the cap.

8. The fluid container cover of claim 7, wherein the recess of the inner surface of the cap comprises grooves that seal with ribs on the air venting component, the ribs surrounding the air vent holes, wherein the grooves are unsealed from the ribs when the nub of the air venting component is deflected.

9. The fluid container cover of claim 1, wherein the air venting component is capable of preventing fluid from exiting the spout when the spout is actuated from the first closed position to the second open position.

10. The fluid container cover of claim 1, wherein the spout is capable of being actuated more than 90 degrees to the second open position.

11. The fluid container cover of claim 1, wherein the plurality of air vent holes are configured in a circular array.

12. The fluid container cover of claim 1, wherein the curved, distal end of the spout comprises a jut, the jut deflecting the nub of the air venting component when the spout is actuated from the first closed position to the second open position.

13. The fluid container cover of claim 1, wherein the diameter of the curved, distal end of the spout is greater than the diameter of the drinking portion of the spout.

14. The fluid container cover of claim 1, wherein the flexible tube comprises silicone.

15. The fluid container cover of claim 1, wherein the air venting component further comprises a support configured to receive a straw, the straw being coupled to the flexible tube.

16. The fluid container cover of claim 15, wherein the straw extends up to 8 inches into the fluid container.

17. A fluid container cover comprising:

a cap having an outer surface and an inner surface, the outer surface having a depression with a slot in a perimeter of the depression, the inner surface capable of being coupled to the fluid container;

a spout comprising a drinking portion, an actuation portion, a protrusion and a curved, distal end, wherein the spout is capable of being pivotally actuated from a first closed position to a second open position by an external force applied on the actuation portion;

a flexible tube coupled inside of the spout, the flexible tube having a length extending past the curved, distal end of the spout;

an air venting component having a nub and a plurality of air vent holes;

wherein when the spout is in the first closed position, the flexible tube is deformed by the curved, distal end of the spout preventing flow through the spout;

wherein when the spout is actuated from the first closed position to the second open position, the curved, distal end of the spout deflects the nub of the air venting component allowing passage of air with the fluid container;

wherein the protrusion of the spout is received by the slot of the cap allowing radial movement of the spout while preventing twisting with respect to a longitudinal axis of the spout when in the second open position.

18. The fluid container cover of claim 17, wherein the air venting component is integral to the flexible tube.

19. The fluid container cover of claim 17, wherein the spout is coupled to the cap by the air venting component.

20. The fluid container cover of claim 17, wherein the air venting component is capable of preventing fluid from exiting the spout when the spout is actuated from the first closed position to the second open position.

* * * * *